US006571420B1

(12) United States Patent
Healy et al.

(10) Patent No.: US 6,571,420 B1
(45) Date of Patent: Jun. 3, 2003

(54) DEVICE AND PROCESS TO REMOVE FLY ASH ACCUMULATIONS FROM CATALYTIC BEDS OF SELECTIVE CATALYTIC REDUCTION REACTORS

(76) Inventors: Edward Healy, Southern Company Services, Inc. P.O. Box 2625, Birmingham, AL (US) 35202-2625; Lothar Bachmann, 175 Dillingham Hill Rd., Auburn, ME (US) 04210; Priya Misra, 2030 Cliff Side Ct., Smyrna, GA (US) 30080

( * ) Notice: Subject to any disclaimer, the term of this patent is extended or adjusted under 35 U.S.C. 154(b) by 0 days.

(21) Appl. No.: 09/705,611

(22) Filed: Nov. 3, 2000

Related U.S. Application Data

(60) Provisional application No. 60/163,319, filed on Nov. 3, 1999.

(51) Int. Cl.[7] ..... B08B 5/02
(52) U.S. Cl. ..... 15/301; 15/316.1
(58) Field of Search ..... 15/301, 316.1, 15/317, 318.1, 345; 423/239.1

(56) References Cited

U.S. PATENT DOCUMENTS 1,026,141 A * 5/1912 Bayer
2,225,946 A * 12/1940 Arey
4,198,725 A * 4/1980 Trutzschler
4,366,003 A * 12/1982 Korte et al.
4,420,313 A * 12/1983 Hada et al.
4,466,383 A * 8/1984 Klatt et al.
5,181,482 A * 1/1993 Labbe et al.
5,661,872 A * 9/1997 Meyer et al.
5,853,683 A * 12/1998 Gobbons et al.

* cited by examiner

*Primary Examiner*—Terrence R. Till
(74) *Attorney, Agent, or Firm*—Pierce Atwood

(57) ABSTRACT

A system for cleaning the fouling and clogging of particulate matter associated with a fluidized gas bed. The system is particularly suited for use with Selective Catalytic Reduction reactors but its use is not limited thereto. The system includes a gas compressor to force cleaning gas through gas injection lines adjacent to retaining structures to be cleaned. The compressor produces sufficient pressure to cause the cleaning gas to dislodge the particulate from the retaining structures. A vacuum system withdraws the dislodged particulate and mixed gas from the reaction chamber.

8 Claims, 1 Drawing Sheet

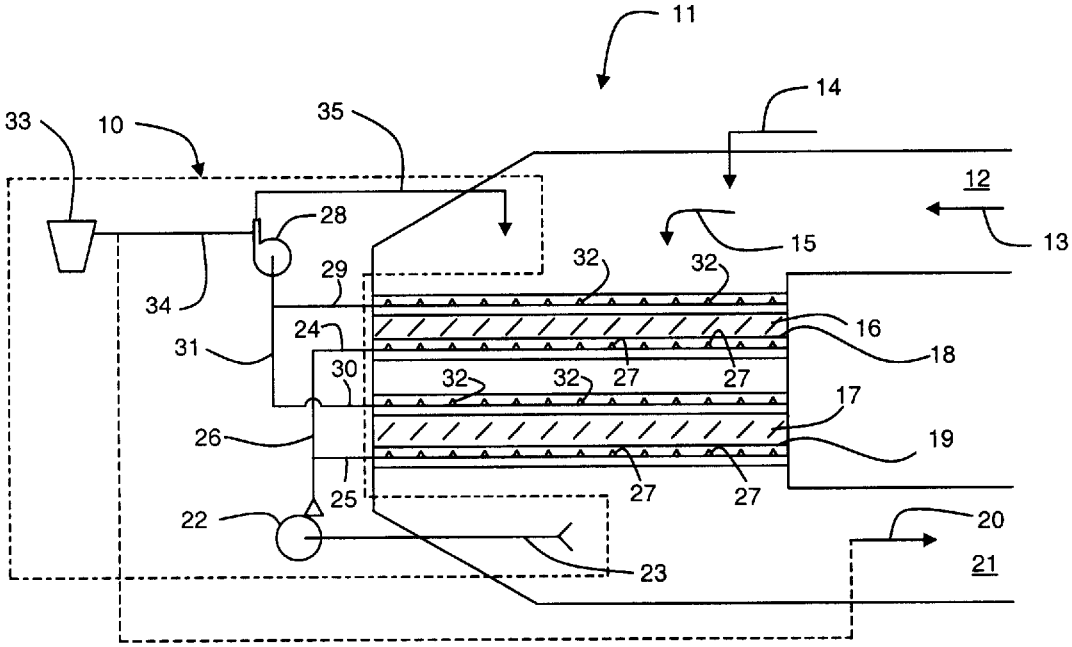
11
14
33
10
35
12
28
15
13
32
32
29
34
24
16
31
30
18
32
32
27
27
17
26
19
25
27
27
22
20
23
21

DEVICE AND PROCESS TO REMOVE FLY ASH ACCUMULATIONS FROM CATALYTIC BEDS OF SELECTIVE CATALYTIC REDUCTION REACTORS

CROSS-REFERENCED TO RELATED APPLICATION

This application claims the priority benefit of U.S. provisional application No. 60,163,319 filed Nov. 3, 1999, of the same title for the same inventors. The content of that application is incorporated herein by reference.

BACKGROUND OF THE INVENTION

1. Field of the Invention

The present invention relates to the removal of particulate from systems having high flow volume therethrough. More particularly, the present invention relates to Selective Catalytic Reduction (SCR) reactors. Still more particularly, the present invention relates to removal of the accumulation of fly ash on the catalyst used in the reduction process.

2. Description of the Prior Art

Selective Catalytic Reduction (SCR) reactors are being employed in fossil fuel-fired electric utility boilers to reduce nitrogen oxide (NOx) emissions generated in the combustion process for such boilers. These reactors are normally installed downstream of the boiler economizer, just upstream of the air preheaters. Operating temperatures range from 600° F.–750° F.

Particulate fly ash matter from coal-fired boilers ranges 5%–30% of coal burned in the boiler. The quantity of fly ash particulate from oil and natural gas-fired boilers is substantially less. This particulate matter is generally transferred with the flue gas through one or more systems designed to clean the flue gas prior to emission. Such systems include SCR reactors, air pre-heaters, precipitators, scrubbers, and others well known to those skilled in the art. As a result of the transfer of ash matter and other contaminants, it is not particularly surprising that these systems, to varying degrees, become contaminated with the matter passing through.

For the SCR reactors that are used to remove certain gases from the flue gas, there are typically two to five layers of catalyst beds installed therein to facilitate removal of the NOx emissions. It is to be noted that the flue gas flow through the SCR reactor is normally vertically downward and so the catalyst beds are installed horizontally to allow the passage of the flue gas therethrough. Alternatively, however, the catalyst layers can also be arranged in a vertical fashion inside the reactor to permit horizontal flue gas flow through the SCR reactor.

An ammonia (NH3) injection system is located in the flue gas ducting upstream of many of the currently designed SCR reactors. The introduction of ammonia may have some effect on the overall treatment process when used in conjunction with the present invention. Of course, in those systems where ammonia input is not used, this is of no concern. It is to be noted, however, that chemical reagents alternative to ammonia may be employed to accelerate the catalytic reduction of the NOx. It is intended that the present invention is directed to the broader design of the SCR reactor and is not limited to any one embodiment associated with chemical reagents that may or may not be used.

Continuing with the specific operation of an SCR reactor, during NOx removal, ammonia gas or its alternative, is injected with the flue gas duct and into the SCR reactor vessel. In the presence of that particular reagent, the following catalytic reactions take place, resulting in conversion of NOx compounds in flue gas to harmless nitrogen compounds and water vapor.

$$4\ NO + 4\ NH_3 + O_2 \rightarrow 4N_2 + 6\ H_2O$$

$$NO + NO_2 + 2\ NH_3 \rightarrow 2\ N_2 + 3\ H_2O$$

Two types of catalyst beds of defined geometry are generally used in the SCR reactor. The two types typically used are: 1) honeycomb-type (or grid-type) and 2) plate-type. Either of the two catalyst beds is normally assembled into standard commercial-size modules to facilitate loading and handling in approximately half-meter or one-meter increments per layer. The catalyst is suspended within the SCR reactor, ordinarily in a plurality of layers, with the catalyst installed one-half to one-meter in depth per layer.

In an exemplar processing operation, flue gas resulting from a combustion process enters the first catalyst layer at a velocity of about 8–20 feet per second. The flue gas passes through holes (honeycomb-type) or slots (plate-type) in the first catalyst layer, exits the first catalyst layer, enters the second catalyst layer, and so on. Holes or slots (also known as hydraulic diameter or pitch opening) in the catalyst layer are normally about 3 mm to 8 mm, closely spaced. In this manner, 70% to 95% of the catalyst layer surface is open to passage of flue gas through it.

Fly ash particle size distribution and particle sizes are highly dependent on the nature of fuel burned and boiler process conditions. In general however, fly ash particles entering the SCR reactor can range in size from about 0.01 mm to about 3 mm in diameter. However, these particles do agglomerate with each other causing particle sizes of 1 cm or larger to form. Of course, particles larger in size than the available catalyst pitch opening, cannot traverse through the catalyst layer, hence these particles collect and continue to build up upstream of the catalyst layer. Moreover, particles nearly equal in size to catalyst hydraulic diameter often lodge inside the catalyst in the holes or slots.

The agglomeration of particles can have a significant adverse impact on the efficiency of the SCR reactor and the boiler. Specifically, the effective reaction zone of the SCR reactor is diminished and so the reaction time is diminished. This naturally affects the entire energy generation system in an adverse way and so it is undesirable to have a build up of particles in the SCR reactor. Since power generation systems, particularly those including SCR reactors, are designed in fine balance, it is important that all subsystems operate substantially as designed. When the operating conditions of the SCR reactor change, the balance of the entire reaction process and therefore the power generation can be altered adversely. In particular, the flue gas must have enough treatment time to ensure NOx removal in line with the design of that reactor. If the SCR reactor is plugged with agglomeration, that treatment time is not provided and the system passes NOx gasses through the remainder of the system. Moreover, if the SCR becomes partially plugged, the fan system used to move gases through the system may not be adequate to overcome the additional pressure drop through the reactor. In sum, there is a fine balance in the system and plugging of the SCR reactor throws that balance off.

Two methods are currently employed to facilitate passage of the flue gas, including the entrained particles, through the catalyst layers. In the first method, traveling sootblowers inject a superheated steam stream of sufficient pressure into the catalyst layers, concurrent with flue gas direction. In the second method, sonic horns are also operated inside the SCR reactor vessels in an effort to excite or vibrate the fly ash particles through the catalyst openings using low-frequency sound energy.

Both of the noted existing methods have an important deficiency. Specifically, neither process acts to remove the particles; instead, they are designed to simply agitate agglomerations in an attempt to dislodge them, assuming that the loosened particles will pass through the catalyst beds. This works to various degrees of effectiveness, however, when a hole or slot is plugged, neither of the noted options is substantially successful in unplugging plugged holes and slots. That results in diminished capacity of the SCR reactor in that the number of reaction sites available in the reactor as designed are not contacted by the flue gas and ammonia mixture.

In regard to the traveling sootblowers in particular, steam is typically drawn from system boiler operation to perform the particle dislodging. That operation consumes a significant amount of system steam that would otherwise be employed in the energy generation operation. Therefore, traveling sootblowers diminish the heat rate of the boiler—an undesirable outcome particularly as even very small changes in system efficiencies translate into significant energy product cost increases. Further, the steam which is used, and which must be used with the sootblower, subsequently can condense within the SCR reactor. That water diminishes catalyst effectiveness and life.

As an alternative cleaning arrangement, the SCR reactor can be shut down, allowed to cool, and the particulate manually removed from the catalyst bed. This process may be time consuming and costly in terms of the power generation process.

Therefore, what is needed is a means for removing particulate matter from systems used to transfer large volumes of particulate-containing fluid. What is also needed is a system for removing particulate from such transfer systems that is relatively non-intrusive to the operation of the system being cleaned and that can be accomplished while the system remains online. Further, what is needed is such a cleaning system that is relatively simple to operate. Yet further, what is needed is such a system for use in association with SCR systems.

SUMMARY OF THE INVENTION

It is an object of the present invention to provide a means for removing particulate matter from systems used to transfer large volumes of particulate-containing fluid. It is also an object of the present invention to provide a cleaning system for removing particulate from such transfer systems that is relatively non-intrusive to the operation of the system being cleaned and that may be used while the system remains online. Further, it is an object of the present invention to provide such a cleaning system that is relatively simple to operate. Yet further, it is an object of the present invention to provide a cleaning system that may be used in association with SCR systems.

These and other objects are achieved in the present invention, which offers an easier and more reliable method of particulate removal. In particular, the present invention is well suited for fly ash particle collection and removal upstream of each catalyst layer in an SCR reactor.

In one proposed embodiment, the invention includes means for injecting relatively high-pressure gas upward through the catalyst layers counter to the direction of the flow of the flue gas to be treated in the SCR reactor. Although the high-pressure gas may come from some external source, it preferably is obtained from the flue gas downstream of the catalyst layers in order to minimize disruption of the catalytic process within the SCR reactor. That is, the high pressure heated reduced flue gas or, alternatively air when the volume of downstream gas is inadequate, is injected counter to the direction of the flow of the flue gas. On the other side of each catalyst layer, fly ash particulate matter is vacuumed at the opposite side of each catalyst layer and re-injected into ducting upstream of the primary particulate collection device, such as an electrostatic precipitator or a fabric filter, or it may be injected downstream beyond the catalyst beds for subsequent cleaning. Optionally, a cleaning unit is coupled to the vacuum system so as to enable removal of the vacuumed particles while further optionally enabling return of the removed gas to the SCR reactor.

These and other advantages of the present invention will become apparent upon review of the detailed description, the accompanying figure, and the appended claims.

BRIEF DESCRIPTION OF THE DRAWING

The FIGURE is a simplified schematic representation of the cleaning system of the present invention.

DETAILED DESCRIPTION OF THE PREFERRED EMBODIMENT

A preferred embodiment of a cleaning system 10 of the present invention in relation to a portion of an SCR reactor 11 is shown in the FIGURE. In brief, the SCR reactor 11 is coupled to one or more upstream systems, such as, for example, the output from a combustion chamber. The combustion chamber may include, but is not limited to, a power-generating boiler (not shown). Contaminated gas, such as products of combustion including hot gases having particulate entrained therein, enters the reactor 11 at port 12. The unreacted gas to be processed in the reactor 11 is represented by arrow 13. Gas 13 may optionally be mixed with ammonia directed into the duct 12 through injector 14. Gas/ammonia mixture 15 then passes through one or more layers 16,17 of catalyst that is retained within catalyst retainers 18,19, respectively. The mixture 15 dwells in the catalyst layers 16,17, where it is converted substantially into nitrogen and water gases. The reduced gas, represented by arrow 20, passes out of reactor duct 21 to downstream systems such as, for example, a particulate collector device such as an electrostatic precipitator or fabric filter (not shown).

The cleaning system 10 includes a compressor 22 for receiving cleaning gas that may either be air or, alternatively, reduced gas 20. If reduced gas 20 is used, the compressor 22 draws that gas in through duct 23. Compressed gas is then passed through one or more gas injection lines 24,25 from primary injection line 26 coupled to the compressor 22. The gas injection lines 24,25 pass into the interior of the SCR reactor 11 and are positioned below the catalyst retainer beds 18,19. They include a plurality of ports 27 through which high pressure gas passes. Traveling rails similar to those currently employed with the traveling sootblowers may be used to position the lines 24,25 where required.

With continuing reference to the FIGURE, vacuum system 28 is coupled to one or more vacuum return lines 29,30 by way of primary return line 31. The vacuum system 28 is designed to draw mixture 15, gas 20, and particulate blown loose by the compressed gas from lines 24,25 out of the areas associated with the catalyst layers 16,17. In that regard, the vacuum return lines 29,30 have entry ports 32 designed with dimensions sufficient to withdraw the particulate and these lines may traverse along the entire catalyst layer surface to vacuum particulate deposited thereon. The same type of travel rails described herein may be used with regard to return lines 29,30.

The vacuum system 28 is optionally coupled to a particulate accumulator 33 by duct 34 so that particulate may be separated from the withdrawn gases. Particulate accumulator 33 may be a cyclonic particulate/gas separation device, an electrostatic precipitator, or a fabric filter, for example. Return gas having particulate substantially removed is then delivered by the vacuum system 28 through duct 35 to the duct 12 of the SCR reactor 11 for reduction. Alternatively, duct 34 may be coupled to duct 21 so that particulate may be directed to downstream cleaning systems.

It is to be noted that the various ducts and gas lines mentioned herein are fabricated of materials suitable for transport of gases of the type that may be used within and outside the SCR reactor 11 with gases of the type suitable for the cleaning purpose described herein. Those skilled in the art will readily recognize the ducting and gas lines required.

The following summarizes the operation of present invention based on the cleaning system 10 shown in the FIGURE.

1. Reduced flue gas is picked up downstream of the SCR reaction region. The reduced gas may be picked up immediately downstream such that it includes entrained particulate. Alternatively, the flue gas may be picked up downstream beyond a particulate removal device. Further, hot air from another source may be employed for injection purposes. Of course, whether flue gas, hot air, or a combination, the temperature of that gas must be high enough to minimize adverse impact on the reduction process. It may be useful to employ ducting that returns the injection gas back through the SCR reactor duct 21 for injection gas heating purposes.
2. The flue gas, air, or combination is compressed to approximately 5 to 10 psig by compressor 22, or any selectable pressure, and injected counterflow to flue gas at each catalyst layer. It is to be noted that cleaning air injection may also occur upstream of each catalyst layer. In each case, an injection pipe may traverse the catalyst layer to provide cleaning coverage of the entire catalyst layer surface.
3. Fly ash particulate matter is vacuumed by vacuum system 28 and particulate-removed flue gas may be re-injected either upstream or downstream of the catalyst layers 16,17.

The noted steps are enacted while the remainder of the entire energy-generation system remains online. Further, the steps may be enacted through a control system that regulates the operation such that cleaning occurs on a regular periodic basis or when there is a change in pressure within the SCR that is sensed to be above some design value signifying substantial build-up of particulate matter on the catalyst layers. At that time, the system may be enabled to remove the particulate until the pressure drop associated with the reactor reaches an acceptable level.

More generally, the present invention can be seen to be a process for cleaning structures that are the subject of fouling and clogging by particulate matter fluidized in the flue gas. The method and related structures to enable the method involve the introduction of a gas that will impinge on the solid clogging matter so as to dislodge it from the surface of the particular clogged structure and remove the dislodged material from the system. Whether that is achieved by directing the gas from the backside of the surface to force the particulate away from the surface, or directly onto the clogged surface to dislodge it is optional. It is to be noted that having the gas directing means, such as gas-flow nozzles, directed counter to the flow of the flue gas, may cause a clogging of such means. In that situation, it may be preferable to provide some means for stowing the gas directing means out of the flue gas path and place them in position when a cleaning is required. Alternatively, the fluidizing gas directing means and the vacuum means may be directed in the same direction and may even form part of a single device.

An important aspect of the invention is the provision of means to ensure that the particulate is substantially removed and pulled out of the fluid pathway of the system, whether that system is an SCR reactor, an air pre-heater, etc. This is accomplished in the present invention while the entire system, including the related boiler and SCR reactor, remains online or offline. Additionally, as indicated, the flue gas may be used as the fluidizing medium. Alternatively, heated air may be used, although both gases may have their deficiencies to be considered in regard to the specific system to which the present device and process are coupled. That is, introducing hot air into the system may diminish the effectiveness of the reaction process in that it displaces the gas to be treated. Nevertheless, use of an external gas may be required if the reaction chamber is too clogged to produce enough flue gas to return to the injection lines. These and other features are contemplated as part of the present invention.

Optionally, with the vacuum system having sufficient vacuum strength, the vacuum system described herein may be used alone to withdraw particulate from the SCR reactor. An important aspect of the invention under that optional configuration is that it would be an automated method for particulate removal that would not require the need to take the SCR reactor offline to manually remove the particulate. Such an automated system would therefore minimize adverse effects on the efficiency of the generation process.

While this description has been directed to a particular embodiment of the invention, it is not intended to be limited thereto. All modifications, equivalents and variations readily understood by those skilled in the art fall within the scope of the invention as described in the claims.

What is claimed is:

1. A system for cleaning accumulated particulate from a chamber through which a particulate-containing gas passes and within which one or more retaining structures are positioned, wherein particulate may accumulate on the one or more retaining structures, the system comprising:

a. means for directing a cleaning gas through said one or more retaining structures with sufficient pressure to dislodge accumulated particulate from said one or more retaining structures and creating a gas/particulate mixture, wherein said cleaning gas is directed in a flow direction counter to the flow direction of the particulate-containing gas; and b. means for removing the gas/particulate mixture from the chamber.

2. The system as claimed in claim 1 wherein said means for directing the cleaning gas includes a compressor coupled to one or more gas injection lines, wherein said gas injection lines are positioned adjacent to the one or more retaining structures and are designed to deliver the cleaning gas.

3. The system as claimed in claim 2 wherein said means for removing the gas/particulate mixture includes a vacuum system coupled to one or more gas return lines, wherein said gas return lines are positioned within the chamber and are designed to withdraw the gas/particulate mixture therefrom.

4. The system as claimed in claim 3 wherein said vacuum system includes a particulate removal device.

5. The system as claimed in claim 4 wherein said particulate removal device is a precipitator.

6. The system as claimed in claim 1 wherein the chamber is an SCR reactor.

7. The system as claimed in claim 1 wherein said cleaning gas is hot air.

8. The system as claimed in claim 1 wherein the cleaning gas is reduced gas.

* * * * *